US005649762A

United States Patent [19]

Dobler

[11] Patent Number: 5,649,762

[45] Date of Patent: Jul. 22, 1997

[54] LIGHTING DEVICE FOR A SELF-PROPELLED VEHICLE, ESPECIALLY A MOTOR VEHICLE

[75] Inventor: Karl-Otto Dobler, Reutlingen, Germany

[73] Assignee: Robert Bosch GmbH, Stuttgart, Germany

[21] Appl. No.: 629,131

[22] Filed: Apr. 8, 1996

[30] Foreign Application Priority Data

Apr. 8, 1995 [DE] Germany ..... 195 13 369.2

[51] Int. Cl.[6] ..... F21V 29/00

[52] U.S. Cl. ..... 362/294; 362/61; 362/345

[58] Field of Search ..... 362/61, 80, 310, 362/345, 294, 373

[56] References Cited

U.S. PATENT DOCUMENTS

| | | | |
|---|---|---|---|
| 4,747,032 | 5/1988 | Weber | 362/294 |
| 4,937,710 | 6/1990 | Hurley et al. | 362/294 |
| 5,003,446 | 3/1991 | Nagengast et al. | 362/294 |
| 5,499,173 | 3/1996 | Yamamoto | 362/294 |

FOREIGN PATENT DOCUMENTS

| | | |
|---|---|---|
| 0474208 | 3/1992 | European Pat. Off. . |
| 4034258A1 | 5/1991 | Germany . |

*Primary Examiner*—Ira S. Lazarus
*Assistant Examiner*—Thomas M. Sember
*Attorney, Agent, or Firm*—Michael J. Striker

[57] ABSTRACT

The lighting device has a housing (10) bounding an interior space (14). An air passage (26) connected to the outer atmosphere is provided in the housing to vent the interior space (14). An exteriorly projecting extension (30) has an inner duct (28) connected with the air passage (26) and extends from the housing. A cap (42) is secured to the exteriorly projecting extension (30) and together with the exteriorly projecting extension (30) forms an outer duct (50) connected with both the outer atmosphere and the inner duct (28). The cap (42) has a resilient finger (48) extending into the inner duct (28) of the exteriorly projecting extension (30) which is elastically pivotable transverse to the insertion direction (52) of the cap (42) and which has an opening (49) so that it locks on a projection (36) protruding from a longitudinal inner wall (32) bounding the inner duct (28). After assembly the cap (42) is no longer removable without being destroyed and thus its loss is reliably prevented without additional assembly effort and expense.

4 Claims, 1 Drawing Sheet

LIGHTING DEVICE FOR A SELF-PROPELLED VEHICLE, ESPECIALLY A MOTOR VEHICLE

BACKGROUND OF THE INVENTION

The present invention relates to a lighting device for a self-propelled vehicle, particularly a motor vehicle. A lighting device for a self-powered vehicle is described in German Published Patent Application DE 40 34 258 A1. This lighting device has a housing which at least partially bounds an interior of the lighting device in which at least one light source is arranged. The housing has at least one air opening provided in an exteriorly projecting extension from the housing. An inner duct connected with the air opening is formed in the exteriorly projecting extension and a closure member is put on the exteriorly projecting extension. An outer duct, which is connected with the outer atmosphere and the inner duct, is formed by the exteriorly projecting extension and the closure member. The closure member has an outer section surrounding the outer periphery of the exteriorly projecting extension. Several locking elements, which engage on the outer section of the closure member surrounding the exteriorly projecting extension, extend from the housing around the exteriorly projecting extension and lock the closure member on the housing. The housing is generally made from a plastic material by injection molding. This type of locking connection of the closure member with the housing requires complex and expensive tools for the making of the housing which should be avoided. Furthermore the closure member is removable from the housing and the prevention of the loss of the closure member from the housing during maintenance work or during strong shaking or heavy vibration cannot be guaranteed. If the closure member is lost, sprayed water can be forced into the interior of the lighting device. Additional assembly effort and expense, for example gluing of the closure member to the exteriorly projecting member, would be required to provide a release-preventing attachment of the closure member to the housing.

SUMMARY OF THE INVENTION

It is an object of the present invention to provide a lighting device for a self-propelled vehicle, particularly a motor vehicle, which does not have the above-described disadvantages.

According to the invention the lighting device for a self-powered vehicle has a housing bounding an interior space, in which at least one light source is arranged, and means for venting the interior space comprising at least one air passage connected to the interior space and provided in the housing, an exteriorly projecting extension extending from the housing in the vicinity of the at least one air passage and provided with an inner duct connected with the at least one air passage and a closure member put on the exteriorly projecting extension and provided with an outer duct connected to both an exterior of the housing and the inner duct. The closure member comprises an outer section surrounding at least an outer periphery of the exteriorly projecting extension and having connection means for locking the closure member to the exteriorly projecting extension. The connection means comprises a longitudinal wall of the exteriorly projecting extension arranged inside the outer section of the closure member, a resilient finger projecting into the exteriorly projecting extension from the closure member and being elastically pivotable transverse to an insertion direction of the closure member on the exteriorly projecting extension and means for locking the longitudinal wall with the resilient finger.

The lighting device according to the invention has the advantage that the closure member or cap is attached to the exteriorly projecting extension from the housing without additional assembly expense and effort so that it cannot be lost without destruction.

In a preferred embodiment of the invention the means for locking the longitudinal wall to the resilient finger includes a projection protruding from the longitudinal wall transverse to the insertion direction and an opening provided in the resilient finger in which the projection locks when the closure member or cap is put on the exteriorly protruding extension. When the cap and exteriorly projecting extension are designed in this way the housing can be made with simple tools by injection molding.

In other embodiments of the invention the longitudinal wall bounds the inner duct and the projection extends into the inner duct. The projection can advantageously have an edge portion pointing in a direction opposite to the insertion direction of the closure member on the exteriorly projecting extension and the edge portion can be bevelled or inclined so as to increase in the insertion direction and the projection can have a shoulder substantially perpendicular to the insertion direction which locks on an edge of the opening of the resilient finger.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENT

Figure 1:
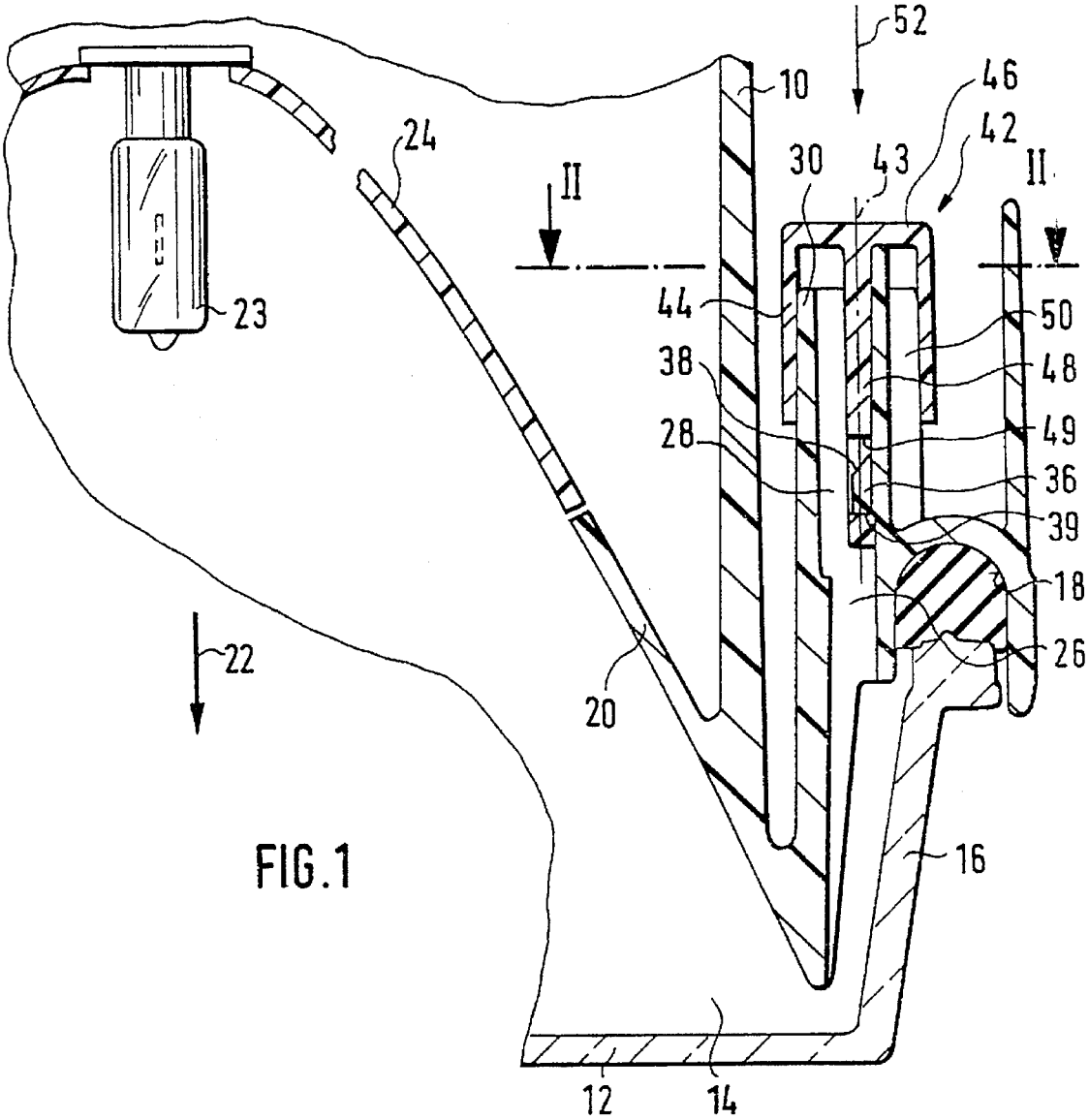
FIG. 1 is a cutaway cross-sectional view through a lighting device for a self-propelled vehicle according to the invention.

The lighting device for a self-powered vehicle, especially a motor vehicle, according to the invention can be a headlight or a light. The embodiment of a lighting device shown in the drawing is a headlight having a housing 10 which is advantageously made of plastic by injection molding. The housing 10 and a cover plate 12 secured on a front edge of the housing 10 surrounding the light outlet opening of the housing 10 bound an interior 14 of the headlight. The cover plate 12 can be a smooth disk or be provided with optical elements. The cover plate 12 has a peripheral edge portion 16 with which it is secured on the front edge of the housing 10 in a circumferential groove 18. The housing 10 has a shield section 20 surrounded by the circumferential groove 18, which extends in the light emission direction 22 at the peripheral edge portion 16 of the cover plate 12 and conically tapers or narrows in a direction opposite to the light emission direction 22. At least one light source 23, which, e.g., can be mounted in a reflector 24 which is only shown in part, is arranged in the interior 14 of the headlight. A gap present between the edge of the reflector 24 and the inner side of the housing 10 is at least partially covered by the shield section 20.

Figure 2:
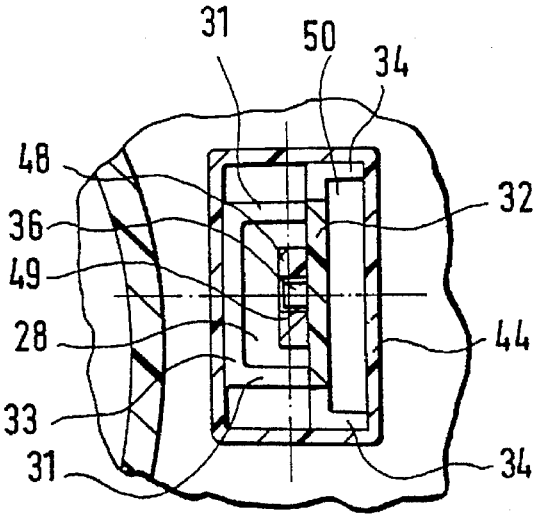
FIG. 2 is a cross-sectional view taken along the section line II—II in FIG. 1.

The housing 10 has at least one air opening 26, through which the interior 14 of the headlight is connected to the outer atmosphere. The air opening 26 is arranged in an edge region of the housing 10 between its shield section 20 and the circumferential groove 18. An inner duct 28, which is provided in an exteriorly protruding extension 30, connects the outside of the housing 10 to the air opening 26. The inner duct 28 and the protruding extension 30 have a substantially rectangular cross-section as shown in FIG. 2, however their cross-section could have any shape according to choice. The exteriorly protruding extension 30 has two transverse walls 31 and two longitudinal walls 32,33, the one longitudinal wall 32 of the exteriorly protruding extension 30 being wider than the other longitudinal wall 33. Two exteriorly directed walls 34 extend from opposite lateral edges of longitudinal wall 32 of the exteriorly protruding extension 30. An open groove extending approximately parallel to the inner duct 28 is formed between the exteriorly directed walls 34. The longitudinal wall 32 of the exteriorly protruding extension 30 projects from the housing 10 beyond the free end of the exteriorly protruding extension 30, which is defined by the ends of both transverse walls 31 and the longitudinal wall 33 as well as the ends of the exteriorly directed walls 34. The portion of the longitudinal wall 32 projecting beyond the free end of the exteriorly protruding extension 30 does not extend over the full width of the longitudinal wall 32 but only over the width of the other longitudinal wall 33. A projection 36 protrudes into the inner duct 28 from the longitudinal wall 32 of the exteriorly protruding extension 30 bounding the inner duct 28. The projection 36 is bevelled or inclined on its edge 38 and points away from the air opening 26 to the longitudinal wall 32 and has a shoulder 39 extending perpendicularly to the longitudinal wall 32 on its edge closest to the air opening 26.

The free end of the exteriorly protruding extension 30 is closable by a closure means comprising cap 42. The cap 42 has an has an exterior section 44, with a cross-section shaped and dimensioned to fit on the cross-section of the exteriorly protruding extension 30, which is substantially rectangular in the preferred embodiment. The cap 42 has a base 46 in one piece with the exterior section 44 and a resilient finger 48 protruding into the inner duct 28 from the base 46 with a flat cross-section. The resilient finger 48 is elastically pivotable transverse to the longitudinal axis 43 of the cap 42 and has near its free end an opening 49 in the form of a depression or throughgoing hole.

For assembly the cap 42 is pushed on the exteriorly protruding extension 30 from the rear side of the housing 10 in the insertion direction 52 shown by the arrow in FIG. 1, so that its exterior section 44 surrounds the outer periphery of the exteriorly protruding extension 30. The resilient finger 48 of the cap 42 is inserted into the inner duct 28 and is pushed over the inclined or bevelled edge 38 on the projection 36 elastically pivoting transverse to the insertion direction 52 as the cap 42 is pushed on the extension 30. In the final position of the cap 42 its base 46 comes into contact with the free end of the longitudinal wall 32 extending beyond the free end of the exteriorly projecting extension 30 so that a free space or gap exists between the free end of the exteriorly projecting extension 30 and the base 46 of the cap 42. In the final position of the cap 42 the projection 36 projects into the opening 49 and an edge of the opening 49 locks on the shoulder 39 of the projection 36. The open groove of the exteriorly projecting extension 30 bounded by the longitudinal wall 32 and the exteriorly directed walls 34 is closed by the exterior section of the cap 42 and forms an outer duct 50. The exterior section 44 of the cap 42 does not extend to the rear side of the housing 10 so that the groove in the housing 10 remains open. The outer duct 50 is connected with the inner duct 28 by the free space between the base 46 of the cap 42 and the free end of the exteriorly projecting extension 30 as well as the free space remaining between the longitudinal wall 32 and the exterior section 44 of the cap 42.

In the previously described lighting device there is an inner duct 28 in the exteriorly projecting extension 30 connected with the air opening 26 and an outer duct 50 connected by the open groove with the outer atmosphere and with the inner duct 28. Because of this it is guaranteed that the interior 14 is connected with the outer atmosphere without providing access for exterior moisture, e.g. sprayed water, to the interior space. The housing 10 with the exteriorly projecting extension 30 formed on it, the projection 36 on the longitudinal wall 32 and the cap 42 with the resilient finger 48 formed on it with the opening 49 are made with simple tools from plastic by injection molding. When the cap 42 is fixed on the exteriorly projecting extension 30, it can not be lost without destroying it, since its resilient finger 48 is arranged inside the exteriorly projecting extension 30 and is not accessible. All that is required is that the cap 42 be pushed on the exteriorly projecting extension 30; no additional assembly expense or effort is required for the release-preventing attachment of the cap.

Alternatively to the above described embodiment the projection 36 could also be directed outward from the longitudinal wall 32, which means projecting into the open groove or the outer duct 50. Then the resilient finger 48 of the cap 42 is correspondingly arranged so that it extends or projects into that groove. Similarly the projection 36 could also be arranged on the other longitudinal wall 33 or on one of the transverse walls 31 of the exteriorly projecting extension 30 in the inner duct 28, whereby similarly the resilient finger 48 is arranged accordingly in the cap 42.

While the invention has been illustrated and described as embodied in a lighting device for a self-propelled vehicle, especially a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is desired to be protected by Letters Patent is set forth in the appended claims.

I claim:

1. A lighting device for a self-powered vehicle, said lighting device comprising a housing (10) bounding an interior space (14), at least one light source arranged in the interior space (14), and means for venting the interior space (14) comprising at least one air passage (26) connected to the interior space (14) and provided in the housing (10), an exteriorly projecting extension (30) extending from the housing (10) in a vicinity of the at least one air passage (26) and provided with an inner duct (28) connected with the at least one air passage (26) and a closure member (42) put on the exteriorly projecting extension (30) and provided with an outer duct (50), said outer duct (50) being connected to both an exterior of the housing and the inner duct (28), said closure member (42) comprising an outer section (44) surrounding at least an outer periphery of the exteriorly projecting extension (30) and having connection means for locking said closure member (42) to the exteriorly projecting extension (30), wherein said connection means comprises a longitudinal wall (32) of the exteriorly projecting extension (30) arranged inside the outer section (44) of the closure member (42), a resilient finger (48) projecting into the exteriorly projecting extension (30) from the closure member (42) and being elastically pivotable transverse to an insertion direction (52) of the closure member (42) on the exteriorly projecting extension (30) and means for locking the longitudinal wall (32) with the resilient finger (48).

2. The lighting device as defined in claim 1, wherein said means for locking the longitudinal wall (32) to the resilient finger (48) includes a projection (36) protruding from the longitudinal wall (42) transverse to the insertion direction (52) and an opening (49) provided in the resilient finger (48) in which the projection (36) locks when the closure member (42) is put on the exteriorly protruding extension (30).

3. The lighting device as defined in claim 2, wherein the longitudinal wall (32) bounds the inner duct (28) and the projection (36) extends into the inner duct (28).

4. The lighting device as defined in claim 2, wherein the projection (36) has an edge portion (39) pointing in a direction opposite to the insertion direction (52) of the closure member (42) on the exteriorly projecting extension (30), the edge portion (39) is bevelled or inclined so as to increase in the insertion direction (52) and the projection (36) has a shoulder (40) substantially perpendicular to the insertion direction (52) which locks on an edge of the opening (49) of the resilient finger (48).

* * * * *